US005082617A

United States Patent [19]

Walter et al.

[11] Patent Number: 5,082,617

[45] Date of Patent: Jan. 21, 1992

[54] THULIUM-170 HEAT SOURCE

[75] Inventors: Carl E. Walter, Pleasanton; Richard Van Konynenburg, Livermore; James H. VanSant, Tracy, all of Calif.

[73] Assignee: The United States of America as represented by the United States Department of Energy, Washington, D.C.

[21] Appl. No.: 578,118

[22] Filed: Sep. 6, 1990

[51] Int. Cl.[5] ..... G21G 1/06

[52] U.S. Cl. ..... 376/184; 376/433; 376/901

[58] Field of Search ..... 376/184, 426, 433, 193, 376/202, 901, 906; 252/644; 165/32 H

[56] References Cited

U.S. PATENT DOCUMENTS

| | | | |
|---|---|---|---|
| 3,421,001 | 1/1969 | Fitzerald et al. | 250/106 |
| 3,603,415 | 9/1971 | Allen | 376/184 |
| 3,672,443 | 6/1972 | Bienert et al. | 165/32 H |
| 3,708,268 | 1/1973 | Mayo et al. | 376/184 |
| 3,725,663 | 4/1973 | Mayo et al. | 376/184 |

FOREIGN PATENT DOCUMENTS 1198862 7/1970 United Kingdom .

OTHER PUBLICATIONS

SNAP-29 Power Supply System Final Report, vol. 1, Jun. 1969.

*Primary Examiner*—Brooks H. Hunt
*Assistant Examiner*—Meena Chelliah
*Attorney, Agent, or Firm*—Henry P. Sartorio; L. E. Carnahan; William R. Moser

[57] ABSTRACT

An isotopic heat source is formed using stacks of thin individual layers of a refractory isotopic fuel, preferably thulium oxide, alternating with layers of a low atomic weight diluent, preferably graphite. The graphite serves several functions: to act as a moderator during neutron irradiation, to minimize bremsstrahlung radiation, and to facilitate heat transfer. The fuel stacks are inserted into a heat block, which is encased in a sealed, insulated and shielded structural container. Heat pipes are inserted in the heat block and contain a working fluid. The heat pipe working fluid transfers heat from the heat block to a heat exchanger for power conversion. Single phase gas pressure controls the flow of the working fluid for maximum heat exchange and to provide passive cooling.

11 Claims, 3 Drawing Sheets

THULIUM-170 HEAT SOURCE

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

1. Field of the Invention

The invention relates to a neutron activated heat source, in particular, an isotopic heat source using the isotope thulium-170.

2. Description of Related Art

Isotopic heat sources use the release of energy from a radioactive isotope. The isotope is created either as a result of fission or by irradiating a target material with neutrons in a nuclear reactor. In neutron irradiation, the target atomic nuclei capture irradiating neutrons and are converted into a neutron activated isotope. The target material is chosen to provide the energy release rate and decay characteristics of interest in the activated target. This energy release can be absorbed as heat and exploited for many uses, such as for a power conversion system.

Typically, reactor target materials are formed into thin flat disks. During irradiation, neutrons are highly absorbed at the target surface, resulting in fewer neutrons available for absorption in the center of the target. The reduction in neutrons, called flux depression, results in lower activation in the target center compared to the target surface. Thin targets provide a more efficient use of target material by reducing flux depression.

Targets may contain a material that acts as a moderator during irradiation. Neutrons that pass through the target atoms unabsorbed can collide with moderator atoms, slow down, and become more susceptible to capture by other target nuclei. Moderators thereby increase the efficiency of the production of the activated isotope. An ideal amount of moderation causes the neutron energy distribution to peak in the energy region of high cross-section for the target material.

Isotopic heat sources are useful when combined with a power conversion system because the energy release is reliable, and the power output diminishes in a known manner as the isotope decays. The heat sources have greater energy density, by several orders of magnitude, than chemical batteries. Depending on the half-life of the isotope, the heat sources can be used for months or years, rather than having a life of hours or weeks that is typical of a chemical battery. The sources are compact and portable, which is especially useful for exploration or surveillance in remote areas such as Antarctica, in space, or underwater.

Presently, isotopic heat sources are available that use isotopes such as strontium-90, cobalt-60, and plutonium-238. These isotopes are environmentally hazardous because they are easily dispersed, and their half-lives are on the order of years.

Thulium-170 has also been considered as a fuel for heat sources. Targets with stable thulium-169 are irradiated and converted into thulium-170 (and thulium-171, etc.). Thulium-169 has a high neutron cross-section, lowering the irradiation time (and cost) needed to produce thulium-170. Thulium is advantageous as a fuel because of its refractory properties; that is, thulium is very stable at high temperatures and has a high melting point (heat of fusion). Thulium-170 is a better heat source from an environmental standpoint because of its relatively short half-life (129 days), its chemical stability, and refractory nature.

Several isotopic heat sources using thulium-170 have been developed. The thulium fuel has been in the form of thulium hydride, thulium metal, thulium oxide, and a mixture of thulium oxide and thulium metal. The thulium fuel is usually encapsulated or encased in a material with a high melting point and low neutron cross-section. These materials are usually metals or high atomic weight (high Z) materials, such as molybdenum, tantalum, tungsten, zirconium, steel, nickel, or platinum-rhodium alloy. The casings provide containment of the target material before and after irradiation.

Using high Z material to encapsulate targets presents several problems: the heat source weight is increased, pre-fabrication of the capsules is needed, and high Z materials produce more bremsstrahlung radiation after target irradiation than low Z materials. Accordingly, a more useful heat source would comprise a refractory fuel with a short half-life and a diluent of low atomic weight (low Z) material. The low Z material would reduce the weight of the heat source. The low Z material would also produce less bremsstrahlung radiation than a high Z material, requiring less shielding. The reduction in shielding and source weight is advantageous in creating portable power sources. Individual thulium fuel parts would not be encapsulated, minimizing pre-fabrication time and expense. Suitable containment would be provided by an outer vessel containing all of the thulium fuel parts.

SUMMARY OF THE INVENTION

The present invention provides a heat source fuel stack that is internally moderated during irradiation and requires minimal shielding due to minimal production of bremsstrahlung radiation. The fuel stack needs little or no post-activation handling, which saves time and prevents prolonged radiation exposure. The invention also provides a heat source apparatus for efficient heat removal.

The fuel stacks comprise an isotopic fuel and a low atomic weight diluent. The fuel, preferably thulium oxide, is refractory and produces an isotope during neutron irradiation with a relatively short half-life. The diluent is refractory and heat conductive, preferably graphite. A stack of thulium oxide fuel and graphite disks is irradiated in a reactor in a conventional manner to form a fuel stack.

In the described embodiment, the heat source apparatus comprises heat pipes for heat removal, a heat block, holes in the heat block for inserting irradiated fuel stacks and heat pipes, a structural container, insulation, and radiation shielding. The irradiated fuel stacks and heat pipes are mounted in the heat block. The heat block, preferably made of graphite, is encased in a sealed structural container that is surrounded by layers of insulation and shielding. The heat pipes extend beyond the container and shielding and contain a heat pipe working fluid. The working fluid transfers heat from the heat source to a heat exchanger. A single phase gas restricts the flow of the heat pipe working fluid at an established interface.

The low atomic weight diluent in the fuel stack has several advantages. In the preferred embodiment, graphite dilutes the thulium oxide fuel and acts as a moderator, increasing the efficiency of thulium-170 production. Graphite and other low Z materials do not produce as much bremsstrahlung radiation as high Z materials; therefore, the fuel stacks require less shielding, reducing the weight of the heat source. Graphite is also an excellent heat conductor, increasing heat removal efficiency.

In the preferred embodiment, the heat source apparatus provides two passive mechanisms for containment and heat dissipation in the case of source overheating. In the first mechanism, the heat pipes are oversized in length to permit passive cooling. A heat pipe working fluid circulates in the heat pipes between the heat source and the heat exchanger. Beyond the heat exchanger, the heat pipe contains a single phase gas. The interface between the working fluid and the single phase gas is preferably located at the heat exchanger. If the heat source temperature increases, the working fluid vapor pressure increases and moves the working fluid-gas interface away from the heat source so the heat pipes have more surface area for cooling. As a second mechanism for providing containment and cooling, the insulation layer is designed to fail at a temperature below the failure temperature of the inner container and its contents.

The present invention has many potential uses. The heat source coupled with a power conversion system provides a reliable, refuelable and relatively long-lasting power source. This type of power system could be used for autonomous or remotely controlled vehicles. These power sources are particularly useful for exploration or surveillance in remote environments such as space or underwater.

DESCRIPTION OF PREFERRED EMBODIMENTS

Figure 1:
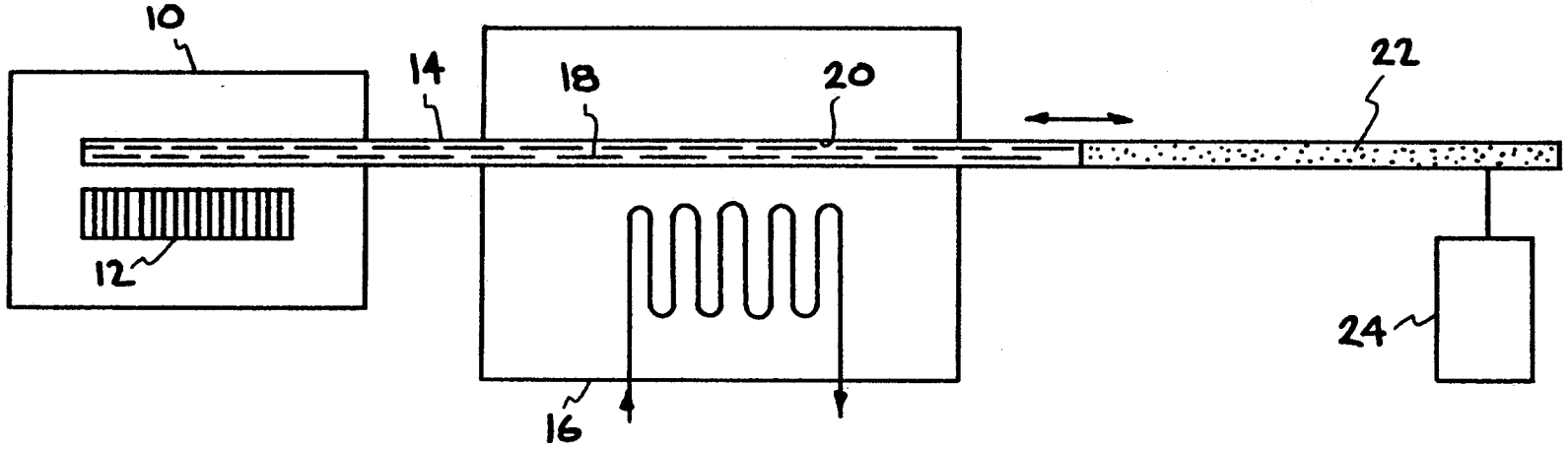
FIG. 1 is a schematic drawing of a heat source in which a heat pipe extends from the heat source to a heat exchanger and is attached to a reservoir of single phase gas.

The preferred embodiment of the invention, shown schematically in FIG. 1, comprises an isotopic heat source 10. For purposes of illustration, one fuel stack 12 is shown adjacent to one heat pipe 14 which extends from the heat source 10 to a heat exchanger 16. The heat pipe 14 contains a working fluid 18 that transfers heat from the heat source 10 to the heat exchanger 16. The working fluid 18 flows along an inner surface 20 of the heat Pipe 14 which comprises means for capillary action. The heat pipe working fluid 18 can be restricted by the pressure of a single phase gas 22, the source of which is a gas reservoir 24.

Figure 2:
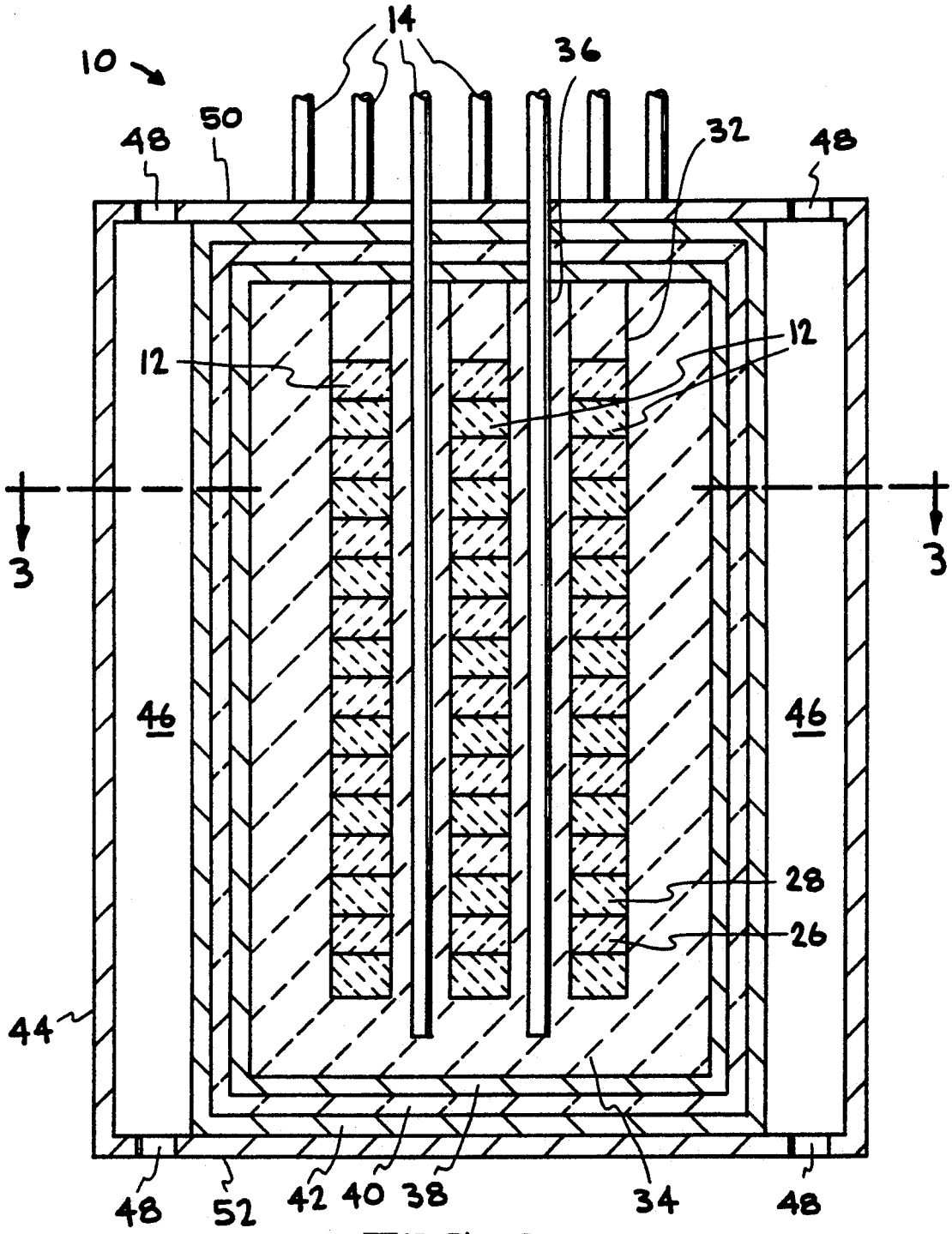
FIG. 2 is a vertical cross-section of an embodiment wherein fuel stacks are positioned next to heat pipes, encased in the heat source apparatus.
Figure 3:
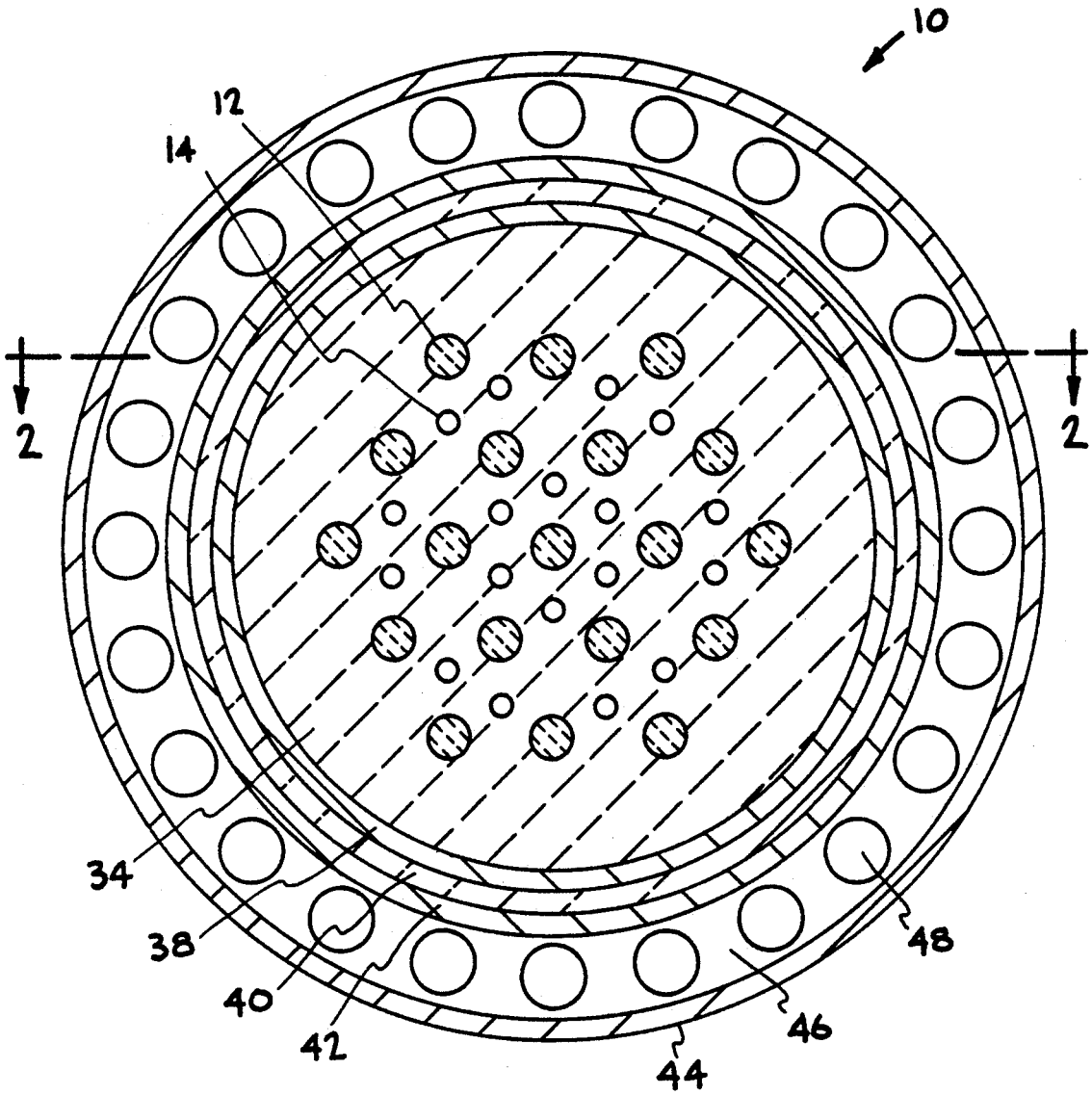
FIG. 3 is a horizontal cross-section of an embodiment wherein cylindrical fuel stacks are arranged with heat pipes in the heat source apparatus.

FIG. 2 is a vertical cross-section of a preferred embodiment of the heat source 10. FIG. 3 is another view of the embodiment shown in FIG. 2 along line 3—3. FIG. 2 illustrates a plurality of fuel stacks 12. The fuel stacks 12 comprise a refractory fuel 26 and diluent 28. The fuel 26 is neutron activated to form a relatively short-lived isotope that produces heat. The preferred embodiment for the fuel 26 is thulium-169 in the form of thulium oxide ($Tm_2O_3$). The diluent 28 is a refractory, heat conductive, and low atomic weight material. The preferred embodiment for the diluent 28 is graphite.

In the preferred embodiment, the fuel stacks 12 are formed of a plurality of thin individual layers of thulium fuel 26 and graphite 28. The thulium layers 26 and graphite layers 28 are stacked in an alternating pattern. The fuel stacks 12 are irradiated in a conventional manner with thermal neutrons, converting thulium-169 to thulium-170 (and thulium-171, etc.).

After irradiation, one or more of the fuel stacks 12 are mounted in one or more holes 32 in a heat block 34, preferably made of graphite. In the preferred embodiment, the fuel stacks 12 are cylindrical and fit snugly into the heat block 34. A plurality of heat pipes 14 for heat removal are arranged in a plurality of holes 36 in the heat block 34. In the preferred embodiment, the heat pipes 14 are enclosed at both ends and may be oversized in length, extending beyond the heat exchanger 16 to provide additional heat rejection area.

The heat block 34 is surrounded by a sealed structural container 38, which is surrounded by an insulation layer 40. The heat block 34 is also encased in at least one layer of radiation shielding 42,44, made from a suitable structural material such as iron or tantalum. In the preferred embodiment, an inner layer of the shielding 42 surrounds the insulation layer 40 and an outer layer of the shielding 44 surrounds the inner layer of the shielding 42. Free convection space fills the cavity 46 defined by the two layers of the shielding 42,44.

Holes 48 defined by the outer layer of the shielding 44 are located along the inside perimeter of the outer layer of the shielding 44. The holes 48 are present at both the top 50 and bottom 52 ends of the heat source apparatus 10.

In the preferred embodiment, the neutron activated fuel 26 is thulium in the form of thulium oxide. However, thulium in the form of thulium hydride or thulium carbide, as well as an altogether different radionuclide, might be used.

In the preferred embodiment, the diluent 28 is graphite. Alternative embodiments for the low atomic weight diluent 28 are possible, including: zirconium hydride (hydrogen), beryllium oxide (beryllium), boron, lithium, and beryllium.

Graphite is advantageous as a diluent 28 for several reasons. Graphite is highly refractory, which allows the heat source 10 to operate at high temperatures. Graphite and thulium oxide do not react appreciably at high temperatures. Also, graphite is readily available and inexpensive.

Diluting thulium layers 26 with intervening graphite layers 28 may enhance the production of thulium-170 in the irradiation reactor and reduce the shielding needed around the fuel stack 12. The production of thulium-170 is increased because graphite acts as a moderator during irradiation. Shielding of the fuel stack 12 is reduced because graphite, being a low atomic weight material, produces less bremsstrahlung radiation than high atomic weight materials. Graphite also stops the beta particles and secondary electrons produced in radioactive decay.

In the preferred embodiment, the fuel stack 12 comprises alternating layers of fuel 26 and diluent 28. The layers of thulium fuel 26 and graphite diluent 28 may be thin, flat, circular individual disks or wafers. The layers of thulium fuel 26 do not exceed one centimeter thickness in order to reduce flux depression. The thulium fuel layers 26 are placed with alternating layers of diluent 28 to form the fuel stack 12. In an alternate embodiment, the thulium fuel 26 can be flame sprayed or plated on graphite disks 28. Thulium oxide powder and graphite powder could also be mixed and heated to form a sintered body.

After the fuel stacks 12 are irradiated, the stacks 12 may be placed directly into the heat block 34, eliminating post-activation handling. Alternatively, graphite layers 28, possibly of another thickness, may be substituted or inserted in the fuel stacks 12 to further minimize bremsstrahlung radiation. Excess graphite layers 28, of course, could be removed.

The fuel stacks 12 are designed to maximize the opportunity for salvaging and recycling thulium fuel 26 and graphite diluent 28 from expended fuel stacks 12. The heat source 10 is designed to permit refueling for long term use.

The heat pipes 14 provide means for heat removal. The heat pipes 14 contain a heat pipe working fluid 18, such as sodium, which is chosen according to the desired heat block 34 temperature. The working fluid 18 transfers heat from the heat source 10 to the heat exchanger 16. The heat pipes 14 are oversized in length to carry the working fluid 18 to the heat exchanger 16 and to permit passive cooling.

In the preferred embodiment, the working fluid 18 transfers heat by repeated cycles of vaporization and condensation. The working fluid 18 vaporizes in the region of the fuel stack 12. The vapor expands and travels through the heat pipe 14 to the heat exchanger 16. The vapor cools, releases heat and condenses onto an inner surface 20 of the walls of the heat pipe 14 in the region of the heat exchanger 16. The inner surface 20 has means to allow capillary action. The condensed working fluid 18 flows back to the heat source 10 region by the capillary action means on the inner surface 20 to begin another cycle of vaporization and condensation. This heat transfer system can operate in a zero gravity environment or in a modest gravity field in any orientation.

During the operation of the heat source 10 with the heat exchanger 16, the flow of the heat pipe working fluid 18 is restricted at an easily controlled interface by a single phase gas 22. The single phase gas 22, such as argon, is supplied from a sealed reservoir 24 attached to a heat pipe 14. The pressure of the single phase gas 22 restricts the flow of the working fluid 18 to direct heat to the heat exchanger 16 for maximum efficiency. Therefore, if the heat block 34 overheats, the vapor pressure of the working fluid 18 increases, causing displacement of the single phase gas 22, thereby expanding the heat rejection surface of the heat pipes 14 and permitting passive cooling. Conversely, if the pressure of the single phase gas 22 is increased, the working fluid 18 is displaced and the surface area of the heat pipes 14 for heat rejection is reduced (shortened).

In an alternative embodiment, the heat pipes 14 need not extend linearly, but may be designed to fold back around toward the heat source 10 to reduce space requirements. Additionally, the number and arrangement of the heat pipes 14 and fuel stacks 12 are variable, depending on the power density and efficiency of heat removal required.

The structural container 38, the insulation layer 40 and the radiation shielding 42,44 may be made of a variety of materials, depending on the particular use requirements. One embodiment for the structural container 38 is an x-ray absorbing material such as tantalum. The preferred embodiment for the insulation layer 40 is a material designed to fail at a high temperature that is below the failure temperature of the structural container 38. In the case of heat block 34 overheating, the insulation layer 40 would melt away, allowing thermal radiation to occur from the structural container 38 to the layer of inner shielding 42, thus providing containment and heat dissipation. Aerogel is one example of such an insulation material.

The free convection space 46 between the layers of the shielding 42,44 provides yet another opportunity for passive cooling of the heat source 10 in the event of heat block 34 overheating.

The description of the invention presented above is not intended to encompass all variations of the system but has attempted to present illustrative alternatives. The scope of the invention is intended to be limited only by the appended claims.

We claim:

1. An isotopic heat source comprising:

at least one isotopic fuel stack, comprising alternating layers of:

thulium oxide; and a low atomic weight diluent for thulium oxide;

a heat block defining holes into which the fuel stacks can be placed;

at least one heat pipe for heat removal, with said heat pipe being positioned in the heat block in thermal connection with the fuel stack; and a structural container surrounding the heat block.

2. A heat source in accordance with claim 1 further comprising, at least one layer of insulation surrounding the heat block.

3. A heat source in accordance with claim 1 further comprising, at least one layer of radiation shielding surrounding the heat block.

4. A heat source in accordance with claim 1 further comprising, two layers of shielding surrounding the heat block and defining a free convection space that separates the two layers of the shielding.

5. A heat source in accordance with claim 1 wherein the heat pipes are oversized in length so as to extend beyond the heat source and the heat exchanger.

6. A heat source in accordance with claim 5 further comprising, a working fluid contained in the heat pipe, said working fluid being suitable for conversion from liquid to vapor phases in the heat source area.

7. A heat source in accordance with claim 6 wherein the heat pipe has an inner surface comprising, means for producing capillary action along the inner surface of the heat pipes so that condensed heat pipe working fluid can flow back along the inner surface of the heat pipes to the heat source area.

8. A heat source in accordance with claim 7 further comprising, a single phase gas reservoir connected to the heat pipe to supply a single phase gas suitable for restricting the flow of the heat pipe working fluid and thus the heat rejection surface of the heat pipe.

9. The isotopic heat source of claim 1 wherein the thulium oxide is thulium-169 oxide which is neutron activated to produce thulium-170 l oxide.

10. The isotopic heat source of claim 1 wherein the diluent is graphite.

11. The isotopic heat source of claim 1 wherein the thulium oxide layers do not exceed 1 cm in thickness.

* * * * *